United States Patent [19]

Tokorozawa et al.

[11] 4,231,707

[45] Nov. 4, 1980

[54] FLUID SUPPLYING DEVICE

[75] Inventors: Sadao Tokorozawa, Nakai; Toyoji Shimizu, Oi; Naomi Yoshizawa, Hatano, all of Japan

[73] Assignee: Pilot Man-Nen-Hitsu Kabushiki Kaisha, Tokyo, Japan

[21] Appl. No.: 6,960

[22] Filed: Jan. 25, 1979

[30] Foreign Application Priority Data

Jan. 31, 1978 [JP] Japan ..... 53-9632

[51] Int. Cl.[3] ..... F04B 49/00

[52] U.S. Cl. ..... 417/12; 417/38

[58] Field of Search ..... 417/12, 477, 38

[56] References Cited

U.S. PATENT DOCUMENTS

| | | | |
|---|---|---|---|
| 3,137,242 | 6/1964 | Hahn | 417/477 |
| 3,730,645 | 5/1973 | Mashakaru | 417/12 |
| 3,737,251 | 6/1973 | Berman | 417/12 |
| 3,938,909 | 2/1976 | Willock | 417/477 |
| 4,142,845 | 3/1979 | Lepp | 417/477 |

*Primary Examiner*—Robert W. Jenkins

*Attorney, Agent, or Firm*—Sughrue, Rothwell, Mion, Zinn and Macpeak

[57] ABSTRACT

A fluid supplying device having a peristaltic pump with a depression and delivery system that includes an elastic tube (17) for receiving fluid and an assembly of depressing members (15) for alternately constricting and relaxing the elastic tube. A drive shaft (10) connects the depression and delivery systems to an electric motor (24). A rotary member (21) is provided on the drive shaft to rotate with the drive shaft and a plurality of discharge-amount transmitting devices (22) are provided on the rotary member in such a manner that the distances between the discharge-amount transmitting devices can be changed as desired. A detector (23) is disposed at the position of passage of the discharge-amount transmitting devices for detecting the discharge-amount transmitting devices and a switch (40) is connected between the detector and the electric motor to deenergize the electric motor.

22 Claims, 18 Drawing Figures

FLUID SUPPLYING DEVICE

BACKGROUND OF THE INVENTION

This invention relates to fluid supplying devices equipped with peristaltic pumps, and more particularly to a fluid supplying pump by which a desired amount of fluid can be obtained.

A peristaltic pump has been extensively employed for blending or supplying reaction raw material, catalyst, coloring agent, photosensitive agent, ink, paint, paste material, resin material, oil, flux, lubricant, cosmetic material, adhesive, food material, etc., because it needs no operating pumping section in the path of fluid. Therefore, the fluid is never brought into contact with such a pumping section, which maintains the characteristic of the fluid unchanged.

In the case where only a peristaltic pump is used, an amount of fluid per unitary time delivered under pressure can be determined. However, it is difficult to discharge a desired amount of fluid.

In order to overcome this difficulty, several fluid supplying devices provided with peristaltic pumps which can discharge a desired amount of fluid have been proposed in the art.

For instance, such a device has been disclosed by Japanese Patent Application Laid-Open No. 41903/1974. In this device, a cam plate having cam sections is mounted on the drive shaft of a peristaltic pump connected to an electric motor and the cam sections are detected by a detector so that the number of cam sections thus detected is applied to a counter. When the count value of the counter reaches a value preset in a manual preset device, a switch connected to the electric motor is opened to stop the motor. As a result a predetermined amount of fluid is delivered; that is, a necessary amount of fluid can be delivered without monitoring it.

Furthermore, U.S. Pat. No. 3,277,356 discloses a fluid supplying device in which a relay is connected to an electric motor operating a peristaltic pump so that the operation (drive and stop) of the peristaltic pump is controlled by the on-off operation of the relay. Swinging pins are connected to the drive shaft which connects the peristaltic pump to the electric motor in such a manner that the pins are rotated for a predetermined distance according to the rotation of the drive shaft. In addition, a pull switch operating the relay is disposed at the position of passage of the pins in such a manner that the position of contact between the switch and the pins can be changed. Thus, a desired amount of fluid is discharged.

In a fluid supplying device disclosed in British Pat. No. 1,216,327, at least three rollers adapted to depress an elastic tube are rotated around one axis by an electric motor. A plurality of stationary contacts arranged in circular form are disposed at the positions of passage of a group of electrical sliding contacts rotated with the rollers so that the sliding contacts can easily slide. Operating signals forming binary codes are supplied to the stationary contacts and are read by the sliding contacts. The code thus read is compared with a code set in a manual digital switch. When both are coincident with each other, the motor is stopped, and a desired amount of fluid has been discharged.

However, these conventional fluid supplying devices are still disadvantageous in that it is impossible to obtain different amounts of fluid successively by a single adjustment of the setting of the device.

SUMMARY OF THE INVENTION

Accordingly, an object of this invention is to provide a fluid supplying device which has eliminated the above-described drawbacks accompanying a conventional fluid supplying device.

It is another object of this invention to provide a device simple in construction, that can discharge not only different amounts of fluid but also a predetermined amount of fluid by adjusting the setting of the device only once, and can change the amount of fluid to be discharged as desired.

A fluid supplying device according to this invention comprises: a peristaltic pump having a depression and delivery system which includes an elastic tube for receiving fluid and an assembly of depressing members for alternately constricting and relaxing the elastic tube. A drive shaft connects the depression and delivery system to an electric motor. A rotary member is provided on the drive shaft to rotate with the drive shaft and a plurality of discharge-amount transmitting devices are provided on the rotary member in such a manner that the distances between the discharge-amount transmitting device can be changed as desired. A detector is disposed at the position of passage of the discharge-amount transmitting devices for detecting the discharge-amount transmitting devices. A switch is connected between the detector and the electric motor to deenergize the motor.

An important feature of the fluid supplying device according to the invention is that the rotary member is connected to the drive shaft of the peristaltic pump to rotate with the drive shaft, a plurality of discharge-amount transmitting devices are provided on the rotary member in such a manner that the distances between the discharge-amount transmitting devices can be changed as desired. A detector for detecting the discharge-amount transmitting devices is provided at the position of passage of the discharge-amount transmitting devices and a switch is connected between the detector and the electric motor to switch off the motor.

The fluid supplying device of the invention is constructed as described above. Accordingly, if the discharge-amount transmitting devices are arranged at equal intervals and then the distance between adjacent discharge-amount transmitting device is increased to an integer multiple of the previous one, then the amount of fluid discharged is increased to an integer multiple by this single adjustment. Furthermore, if the distances are made irregular, then different amounts of fluid are discharged successively by the adjustment. The rotary member employed in the fluid supplying device may be a circular, elliptic, triangular, polygonal, rectangular or trapezoid plate, or a rectangular paralleopiped or regular hexahedron block. Furthermore, the rotary member may be opaque or transparent.

The discharge-amount transmitting devices may be screws screwed into holes in the rotary member, or rods or plates engaged with holes such as through-holes, blind holes or groove-shaped slots formed in the rotary member. The distances between the discharge-amount transmitting devices can be changed by installing them on the rotary member or removing them therefrom or by putting them in the rotary member or putting them out of the rotary member. Furthermore, if the rotary member is optically transparent, the distances can be changed as desired by placing light shielding materials on the rotary member or removing them therefrom. If the rotary member is a disk, the discharge-amount transmitting devices may be provided on the circumferential surface or the side of the rotary member. If the rotary member is not a disk, it is suitable to place the discharge-amount transmitting devices on the side thereof.

The detector of the fluid supplying device should be selected according to the type of discharge-amount transmitting device employed. For instance, a microswitch, a limit switch, a pressure-sensitive switch, a photo sensor comprising a light emission element and a photoelectric element, or a read switch can be selectively employed as the detector.

The peristaltic pump employed in the invention may be one in which constriction and relaxation of the elastic tube are alternately carried out by the up and down movement of at least three depressing members provided in the depression and delivery system thereof. Alternatively, it may be one in which the depression and delivery system has at least two rollers which are arranged to rotate along a circular path to depress the elastic tube inserted between the circular path and the rollers. Also, it may be one in which the elastic tube is placed on a flat surface and the tube is cyclically depressed at least two roller-shaped depressing members of the depression and delivery system which are disposed along the tube.

The size and material of the elastic tube and the number of elastic tubes can be selected as required. However, in the case of pumping liquid, it is desirable to use a capillary tube 0.1 to 3.0 mm in inside diameter so that, when the electric motor is stopped, the liquid remaining between the depression and delivery system and the discharge end of the elastic tube will not flow out.

The elastic tube may be preferably made of polyethylene, polypropylene, vinyl chloride, nylon, polyester, fluoro-resin rubber, silicon rubber, or a like material.

The fluid supplying device according to the invention can be used to discharge (or pump) ink, paint such as vinyl paint, paste material, resin material, oil, flux, lubricant, cosmetic material such as manicure paint, vinyl adhesive, adhesive such as cyanoacrylate, food material such as vanilla essence, or the like.

The electric motor employed in this invention may be provided with an electronic circuit for momentarily stopping the motor.

According to another aspect of this invention, a fluid supplying device is provided in which a preset counter is connected to the above-described detector, and a switch is connected between the counter and the electric motor to switch off the motor.

In the situation where, as was described herein, the discharge-amount transmitting devices arranged at equal intervals or at irregular intervals are combined with the detector connected through the switch to the motor, an amount of fluid is discharged in correspondence to the distances between the discharge-amount transmitting devices thus adjusted. Conversely, in the case where the present counter is combined with the discharge-amount transmitting devices, an amount of fluid corresponding to the sum of the distances between the discharge-amount transmitting device, which is equal to the number preset therein, is obtained. Accordingly, it is unnecessary to increase the size of the rotary member and this results in a compact fluid supplying device. The use of the preset counter is advantageous in the case where it is required to discharge different amounts of fluid by making the distances between the discharge-amount transmitting devices non-uniform. For instance, if the number of discharge-amount transmitting devices is set to three (3) so that the first and second discharge-amount transmitting devices are separated by 60°, the second and third ones by 120°, and the third and first ones by 180°, and if it is assumed that 0.01 cc is discharged for every 60°, then with the preset counter set to "4", 0.07 cc is discharged in the first cycle, 0.08 cc is dischargd in the second cycle, 0.09 cc is discharged in the third cycle and so on when the count value of the preset counter reaches "4".

Furthermore, according to another aspect of the invention, a fluid supplying device is provided in which a preset counter is connected to the detector. A switch is connected between the preset counter and the electric motor to switch off the latter, and a preset counter change-over switch connecting the aforementioned switch to the detector is provided.

In this fluid supplying device, an amount of fluid corresponding to the distances between the discharge-amount transmitting devices or corresponding to the sum of the distances between the discharge-amount transmitting devices, which is equal to the number preset therein can be discharged by operating the change-over switch.

In addition, according to another aspect of the invention, a fluid supplying device is provided in which a preset counter is connected to the aforementioned detector. A switch is connected between the counter and the motor to switch off the latter, and a change-over switch is provided between an electric source and a circuit including a preset counter change-over switch connecting the first mentioned switch and the detector, to switch off the electric source.

With this fluid supplying device, when the change-over switch is switched to one side, the fluid is continuously discharged. When the change-over switch is switched to the other side, an amount of fluid corresponding to the distances between the discharge-amount transmitting device or corresponding to the sum of the distances between the discharge-amount transmitting devices, which is equal to the number preset therein, can be discharged.

The novel features which are considered characteristic of this invention are set forth in the appended claims. This invention itself, however, as well as other objects and advantages thereof will be best understood by reference to the following detailed description of illustrative embodiments, when read in conjunction with the accompanying drawings.

DESCRIPTION OF THE PREFERRED EMBODIMENT

Figure 1:
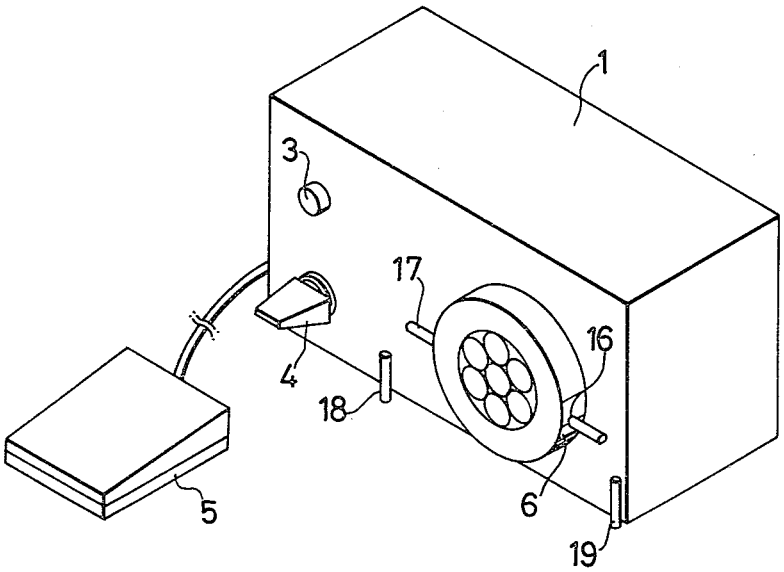
FIG. 1 is a perspective view showing one example of a fluid supplying device according to this invention.
Figure 2:
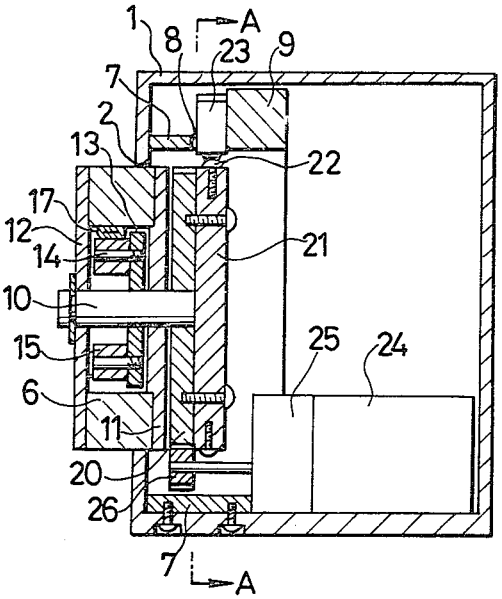
FIG. 2 is a sectional view showing the essential components of the fluid supplying device shown in FIG. 1.
Figure 3:
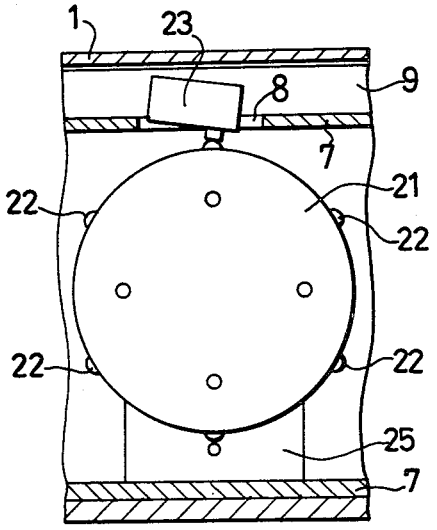
FIG. 3 is a sectional view taken along line A—A in FIG. 1.

A first example of a fluid supplying device according to this invention is as shown in FIGS. 1 through 6. In this device, a circular opening 2, an indication lamp 3 and a toggle switch 4 to power the device are provided on the front plate of a housing 1. In addition, a foot switch 5 is connected to a circuit (described later) provided in the housing 1. An annular case 6 is fitted into the circular opening 2 and a frame 7 is disposed inside the housing 1 in such a manner that it surrounds the peripheral edge of the bottom of the annular case 6.

The upper portion of the frame 7 is provided with a slit 8 (FIG. 2) and a protrusion 9 extended therefrom. The lower portion or bottom of the frame is fixedly secured to the bottom wall of the housing 1 with screws. The openings of the annular case 6 are covered with a bottom plate 11 with a hole, and a cover plate 12 with a hole, respectively. Blades 11 and 12 serve as bearings of a drive shaft 10.

A disk 13 is mounted on the drive shaft 10 pivotally supported by the bottom plate 11 and the cover plate 12. The disk 13 has six pins 14 embedded at equal intervals on the coaxial circle of the drive shaft 10. Six depressing members 15, or cylindrical rollers, are mounted on the pins 14 so that they are rotable without making contact with one another.

Furthermore, the depressing members 15 are arranged so that they revolve around the drive shaft 10 when the disk 13 is rotated. Tube holding holes 16 are provided at diametrically opposite portions of the annular case 6. An elastic tube 17 larger in diameter than the tube holding holes 16 is inserted into the tube holding holes 16 under pressure in such a manner that it is press-fitted between the depressing member 15 and the inner wall of the annular case 6. One of both end portions of the elastic tube 17 is employed as a fluid receiving end 18, while the other end portion is employed as a fluid discharging end 19. A gear 20 is mounted on the drive shaft 10, and a disk-shaped rotary member 21 is secured to the gear 20 with screws. As a result, the drive shaft 10, the gear 20 and the rotary member 21 form one unit.

Six discharge-amount transmitting devices 22 (FIG. 3) are provided at equal intervals on the circumferential surface of the rotary member 21, which is coaxial circle of the drive shaft 10. A detector 23 which comprises a microswitch and operates in association with the discharge-amount transmitting devices is fixedly secured to a side of the protrusion 9 in the frame 7. It is secured so that it protrudes through the slit 8 and it can be brought into contact with the discharge-amount transmitting devices 22. The gear 20 is engaged with a gear 26 which is connected to the drive shaft of a gear head 25 connected to an electric motor 24.

Figure 4:
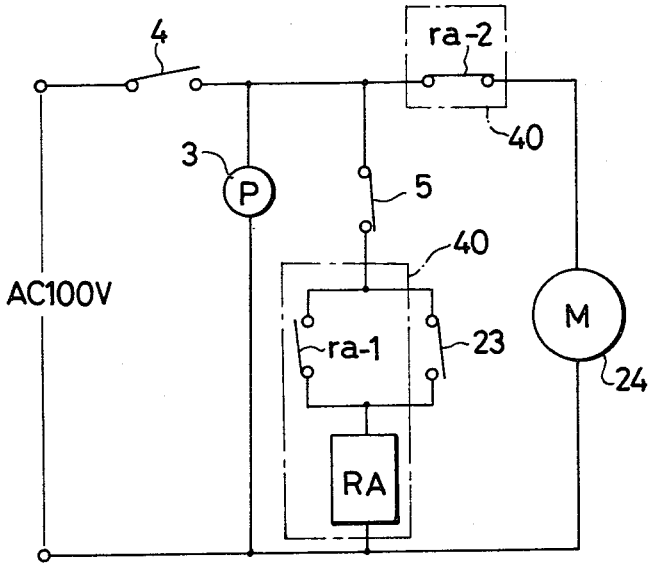
FIG. 4 shows an electrical circuit of the device shown in FIGS. 1 through 3.

The indication lamp 3, the toggle switch 4, the foot switch 5, the detector 23, and the motor 24 are connected as shown in FIG. 4. A relay RA has contact means ra-1 and ra-2. Relay RA and the contact means ra-1 and ra-2 form a switch 40.

Figure 5:
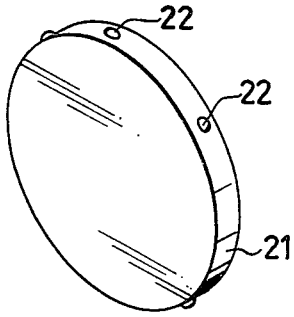
FIGS. 5 through 14 are perspective views and sectional views showing various examples of a rotary member employed in the invention, on which discharge-amount transmitting devices are provided.
Figure 6:
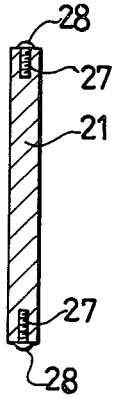
Figure 7:
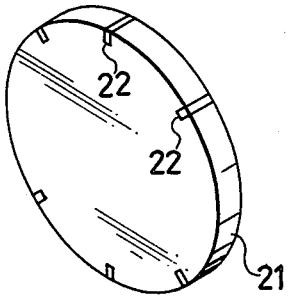
Figure 8:
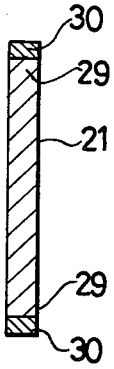

The discharge-amount transmitting devices 22 can be obtained by inserting small elements 28, such as screws, into holes 27 provided in the circumferential surface of the disk as shown in FIGS. 5 and 6. Accordingly, the number of discharge-amount transmitting devices can be adjusted by the installation or removal of the small elements 28.

In the case where a fluid is discharged, first the number of discharge-amount transmitting devices 22 is set, and the detector 23 is brought into contact with one small element 28. Then, the toggle switch 4 is closed. As a result, the relay RA is self-held to open the contact means ra-2. Thereafter, the foot switch 5 is depressed and as a result the self-holding operation of the relay RA is released to close the contact means ra-2. The motor 24 is therefore energized to rotate the drive shaft 10.

As the drive shaft 10 is rotated, the disk 13 secured to the drive shaft 10 is rotated, and the depressing members 15 provided on the pins 14 on the disk 13 revolve around the drive shaft 10. As the depressing members 15 revolve, the elastic tube 17 inserted between the assembly of the depressing members 15 and the inner wall of the annular case 6 is depressed and alternately released. Hence, the fluid is introduced into the fluid receiving end 18 of the tube. In this example, the motor 24 is stopped whenever the detector 23 detects each small element 28 of the rotary member 21. Accordingly, it is necessary to depress the foot switch 5 until the entire tube 17 is filled with the fluid.

When the foot switch 5 is depressed after the entire elastic tube 17 has been filled with the fluid, the detector 23 in contact with one small element 28 is brought into contact with the following small element 28 to stop the motor 14. In this operation, an amount of fluid corresponding to the distance between the first and the second small elements 28 is delivered under pressure to the fluid discharging end 19. That is, the amount of fluid mentioned is discharged out of the fluid discharging end 19. When the detector 23 makes contact with the small element 28, the relay RA is operated to close the contact means ra-1 to self-hold the relay RA. As a result, contact ra-2 is opened to stop the motor 24.

When the foot switch 5 is depressed again, the self-holding state of the relay RA is released and the contact means ra-2 is closed to operate the motor 24. Thus, similarly as in the above-described case, the fluid is discharged. If the foot switch 5 is depressed after each other small element 28 is removed from the rotary member—three small element 28 are removed therefrom—, then an amount of discharge is increased to twice that in the above-described case.

Other examples of the discharge-amount transmitting device 22 are shown in FIGS. 7 through 14. In the discharge-amount transmitting device shown in FIGS. 7 and 8, slots 29 are formed in the circumferential surface of the rotary member 21. Mating plate-shaped small elements 30 are inserted into the slots 29 thus formed. The number of small elements 30 may be obtained as desired by installing or removing them.

Figure 9:
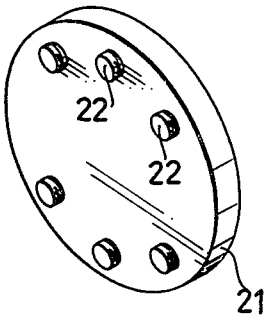
Figure 10:
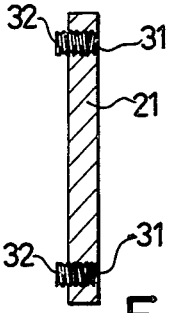

In the discharge-amount transmitting device shown in FIGS. 9 and 10, threaded through-holes 31 are cut in the rotary member 21, and mating small elements 32 such as threaded rods are screwed into the through-holes 31. The number of small pieces 32 can be changed by installing or removing them or by screwing the small elements 32 in or out of the threaded through-holes 31. In this case, a photo sensor is suitable as a detector to detect the through-holes from which the elements 32 have been removed.

Figure 11:
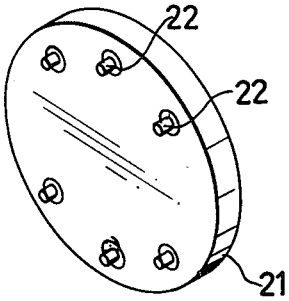
Figure 12:
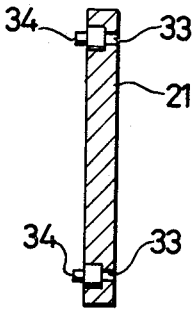

In the discharge-amount transmitting device shown in FIGS. 11 and 12, through-holes 33 are cut in the rotary member 21 in such a manner that one opening of each through-hole 33 is larger in diameter than the other opening thereof. This is best illustrated in FIG. 12, and shouldered small pieces 34 similar in configuration to the through-holes 33 are inserted into the through-holes 33. The number of discharge-amount transmitting devices can be changed by removing the small elements 34 and by inserting them into the through-holes in a direction opposite to the previous direction.

Figure 13:
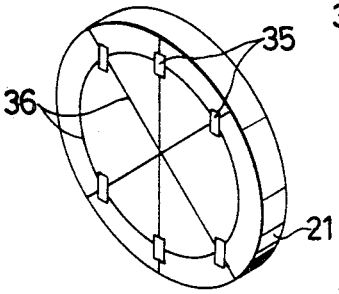
Figure 14:
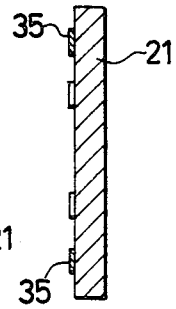
Figure 15:
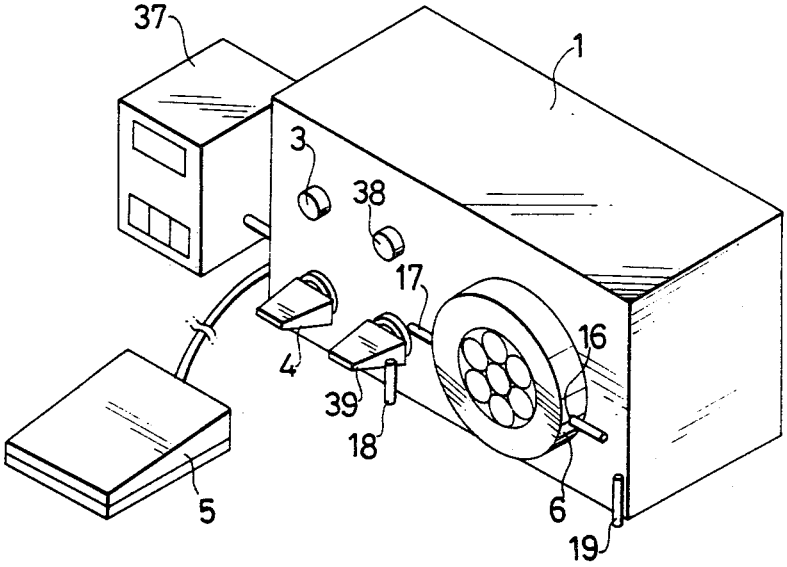
FIG. 15 is a perspective view showing another example of the fluid supplying device according to the invention.
Figure 16:
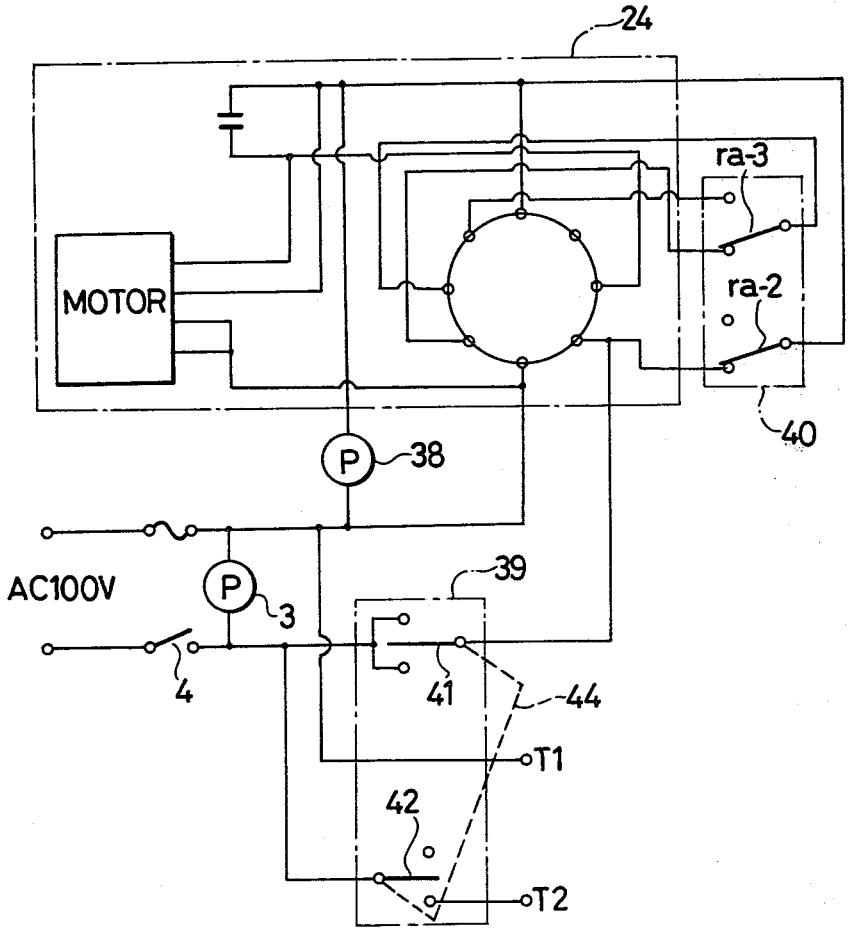
FIG. 16 is a partial circuit diagram of the device shown in FIG. 15.
Figure 17:
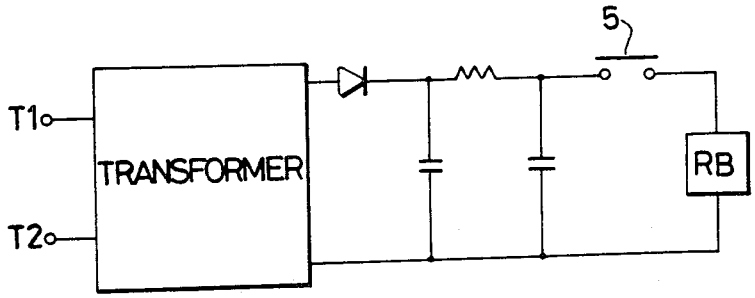
FIGS. 17 and 18 are partial circuit diagrams which are to be connected to terminals $T_1$ and $T_2$ of the circuit in FIG. 15.

In the example shown in FIGS. 13 and 14, a disk-shaped rotary member 21 is made of optically transparent material such as glass or transparent plastic, and small pieces 35 of adhesive tape are stuck on the surface of the rotary member 21. The number of discharge-amount transmitting devices can be changed by sticking the small pieces 35 onto the rotary member 21 or removing them therefrom. In this case, a photo sensor is employed as the detector. The small pieces 35 should be stuck on the rotary member 21 by utilizing the guide lines 36 marked thereon.

A second example of the fluid supplying device according to the invention is shown in FIGS. 15 through 18. This device is different from the first example in that a preset counter 37 is provided. In other words, in the device, the preset counter 37 typically a "Digital Counter", Type H7A-2D, manufactured by Tateishi Denki Co. is connected to a detector 23, and a switch 40 is connected between the counter and an electric motor 24. The switch 40 comprises a relay RA and its contact means ra-1, ra-2 and ra-3. A preset count change-over switch 43 (not shown in FIG. 15) is provided to connect the switch 40 to the detector 23 and a toggle switch or change-over switch 39 is provided.

Figure 18:
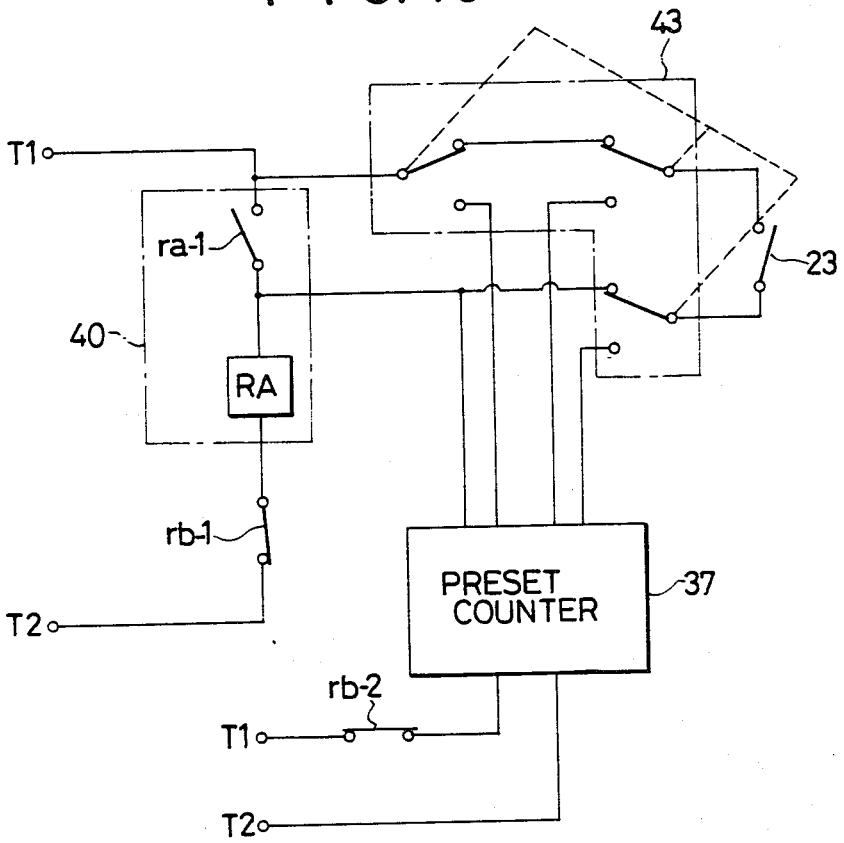

The change-over switch 39 comprises switch sections 41 and 42, and the switch section 41 has its movable contact or armature connected to the motor 24. The switch section 42 functions as a power switch to a momentary operation circuit comprising a foot switch 5 and a relay RB (FIG. 17) and to a circuit comprising the preset counter 37, the detector 23, a self-holding circuit having the relay RA, and the preset counter change-over switch 43 (FIG. 18). The relay RB has its contact means rb-1 and rb-2.

(a) If a switch member 44 is turned on to trip the armatures of the change-over switch 39 to the upper contacts of $T_1$ and $T_2$ (as viewed in FIG. 16) contacts, then the fluid can be continuously discharged.

(b) If the armatures of the switch 39 are caused to trip to the lower contacts to thereby trip the armatures of the preset counter change-over switch 43 to the upper (as viewed in FIG. 18) contacts, then as in the above-described example, the fluid can be discharged intermittently by using only the foot switch 5. If the continuous fluid discharge is carried out before the intermittent fluid discharge, the discharge-amount transmitting devices 22 will not make contact with the detector 23. In this case, the detector 23 is open and the relay RA is therefore not operated. Accordingly, the armatures of the contact ra-2 and ra-3 are in contact with the lower (as viewed in FIG. 16) contacts to energize the motor 24. As a result, the drive shaft 10 is rotated as much as one discharge-amount transmitting device 22, and is then stopped by means of the detector 23.

Upon depression of the foot switch 5, the relay RB is operated momentarily, whereupon the contact means rb-1 and rb-2 are opened. As a result, the self-holding operation of the relay RA is released, and accordingly the armatures of the contact means ra-2 and ra-3 are tripped to the lower (as viewed in the figure) contacts to operate the motor 24. The drive shaft 10 is rotated and it is thereafter stopped by the detector 23.

(c) Now, the case where the preset counter 37 is used will be described.

First, the armatures of the change-over switch 39 are brought into contact with the lower contacts and the armatures of the preset counter change-over switch 43 are brought into contact with the lower contacts, respectively. Then, a manual digital switch of the preset count 37 is set to a desired number, whereupon the motor 24 begins to operate. The detector 23 is brought in contact with the discharge-amount transmitting device 22 by the operation of the motor 24. As a result, the detector 23 transmits a signal to the preset counter 37, and the signal is counted. When the count value of the preset counter 37 reaches the predetermined value, the contact output of the preset counter 37 is closed. As a result, the relay RA is self-held to cause the armatures of the contacts ra-2 and ra-3 to trip over to the upper contacts, respectively, to stop the motor 24. If the manual digital switch is set to the same number again and the foot switch 5 is depressed, the same amount of fluid is discharged again. That is, the relay RB is momentarily operated to open the contact means rb-1 and rb-2. When the relay contact means rb-1 is opened, the self-holding state of the relay RA is released, and accordingly the armatures of the relay contact means ra-2 and ra-3 are tripped over to the lower contacts to operate the motor 24. When the relay contact means rb-2 is opened, the counting section of the preset counter 37 is reset to zero (0).

In the above-described example, the discharge-amount transmitting devices 22 are disposed at equal intervals. However, it is apparent that if the devices 22 are arranged at irregular intervals, different amounts of fluid are discharged.

Furthermore, in the above-described example, the rotary member 21 is secured to the gear 20 with screws. However, if the construction and arrangement of the relevant parts are somewhat changed, the rotary member 21 can be secured to the drive shaft extended from the gear head 25.

As is apparent from the above description, the fluid supplying device according to the invention is designed so that the number of discharge-amount transmitting devices can be changed as desired. Accordingly, the user can discharge the desired amount of fluid. The fluid supplying device according to the invention is simple in construction and operation, and can be manufactured at low cost.

It is apparent that other modifications can be made without departing from the scope of this invention.

What is claimed is:

1. A fluid supplying device comprising: a peristaltic pump including depression and delivery means and an electric motor, said depression and delivery means including an elastic tube (17) for receiving fluid and an assembly of depressing members (15) for alternately constricting and relaxing said elastic tube, and a drive shaft (10) connecting said depression and delivery means to said electric motor (24); a rotary member (21) disposed on said drive shaft to rotate with said drive shaft; a plurality of discharge-amount transmitting means (22) provided on said rotary member such that the distances between respective discharge-amount transmitting means can be varied; a detector (23) disposed relative to said discharge-amount transmitting means for detecting the passage of said discharge-amount transmitting devices; and a switch (40) connected between said detector and said electric motor to selectively deenergize said electric motor.

2. A device as claimed in claim 1, wherein said peristaltic pump comprises, at least two roller-shaped depressing members arranged so as to rotate along a circular path, said depressing members adapted to depress said elastic tube inserted between said circular path and said depressing members.

3. A device as claimed in claim 1, in which said discharge-amount transmitting means comprises small elements selectively installed on said rotary member or removed therefrom; said small elements having variable positioning relative to the face of said rotary member.

4. A device as claimed in claim 1, in which said detector for detecting said discharge-amount transmitting means is one selected from the group consisting of a microswitch, a limit switch, a pressure-sensitive switch, a photo sensor and a reed switch.

5. A device as claimed in claim 1, in which said switch is a self-holding type relay.

6. A device as claimed in claim 5, further comprising an electric source and a foot switch interposed between said self-holding type relay and said electric source.

7. A fluid supplying device comprising: a peristaltic pump including depression and delivery means and an electric motor said depression and delivery means including an elastic tube (17) for receiving fluid and an assembly of depressing members (15) for alternately constricting and relaxing said elastic tube, and a drive shaft (10) connecting said depression and delivery means to said electric motor (24); a rotary member (21) provided on said drive shaft to rotate with said drive shaft; a plurality of discharge-amount transmitting means (22) provided on said rotary member such that the distances between respective discharge-amount transmitting means can be varied; a detector (23) disposed at the position of passage of said discharge-amount transmitting means for detecting the passage of said discharge-amount transmitting means; a preset counter (37) connected to said detector; and a switch (40) connected between said preset counter and said electric motor to selectively deenergize said electric motor.

8. A device as claimed in claim 7, wherein said peristaltic pump comprises, at least two roller-shaped depressing members arranged so as to rotate along a circular path, said depressing members adapted to depress said elastic tube inserted between said circular path and said depressing members.

9. A device as claimed in claim 7, in which said discharge-amount transmitting means comprises small elements selectively installed on said rotary member or removed therefrom; said elements having variable positioning relative to the face of said rotary member.

10. A device as claimed in claim 7, in which said detector for detecting said discharge-amount transmitting means is one selected from the group consisting of a microswitch, a limit switch, a pressure-sensitive switch; a photo sensor and a reed switch.

11. A device as claimed in claim 7, in which said switch is a self-holding type relay.

12. A device as claimed in claim 11, further comprising, an electric source, and a foot switch interposed between said self-holding type relay and said electric source.

13. A fluid supplying device comprising: a peristaltic pump including depression and delivery means and an electric motor, said depression and delivery means including an elastic tube (17) for receiving fluid and an assembly of depressing members (15) for alternately constricting and relaxing said elastic tube, and a drive shaft (10) connecting said depression and delivery means to said electric motor (24); a rotary member (21) provided on said drive shaft to rotate with said drive shaft; a plurality of discharge-amount transmitting means (22) comprising small elements provided on said rotary member such that the distance between said discharge-amount transmitting means can be varied; a detector (23) disposed at the position of passage of said discharge-amount transmitting means, for detecting said small elements; a preset counter (37) connected to said detector; a switch (41) connected between said preset counter and said electric motor to selectively deenergize said electric motor; and a preset counter change-over switch (43) connecting said detector to said switch (40).

14. A device as claimed in claim 13, wherein said peristaltic pump comprises, at least two roller-shaped depressing members arranged so as to rotate along a circular path, said depressing members adapted to depress said elastic tube inserted between said circular path and said depressing members.

15. A device as claimed in claim 13, in which said detector for detecting said discharge-amount transmitting means is one selected from the group consisting of a micro-switch, a limit switch, a pressure-sensitive switch, a photo sensor and a reed switch.

16. A device as claimed in claim 13, in which said switch is a self-holding type relay.

17. A device as claimed in claim 16, further comprising, an electric source and a foot switch connected between said self-holding type relay and said electric source.

18. A fluid supplying device comprising: a peristaltic pump including depression and delivery means and an electric motor, said depression and delivery means including an elastic tube (17) for receiving fluid and an assembly of depressing members (15) for alternately constricting and relaxing said elastic tube, and a drive shaft (10) connecting said depression and delivery means to said electric motor (24); a rotary member (21) provided on said drive shaft to rotate with said drive shaft; a plurality of discharge-amount transmitting means (22) in the form of small elements provided on said rotary member such that the distances between said discharge-amount transmitting means can be varied; a detector (23) disposed at the position of passage of said discharge-amount transmitting means for detecting said small elements; a preset counter (37) connected to said detector; a switch (40) connected between said preset counter and said electric motor to selectively deenergize said electric motor; a change-over switch (39) provided between and electric source and a circuit including a preset counter change-over switch (43) connecting said switch (40) to said detector, for turning off said electric source.

19. A device as claimed in claim 18, wherein said peristaltic pump comprises at least two roller-shaped depressing members arranged so as to rotate along a circular path, said depressing members adapted to depress said elastic tube inserted between said circular path and said depressing members.

20. A device as claimed in claim 18, in which said detector for detecting said discharge-amount transmitting means is one selected from the group consisting of a microswitch, a limit switch, a pressure-sensitive switch, a photosensor and a reed switch.

21. A device as claimed in claim 18, in which said switch is a self-holding type relay.

22. A device as claimed in claim 21, further comprising a momentary operation circuit including a foot switch provided between said self-holding type relay and said electric source.

* * * * *